US005954921A

United States Patent [19]

Dahmen et al.

[11] Patent Number: 5,954,921

[45] **Date of Patent: *Sep. 21, 1999**

[54] PAPER-SIZING AGENTS CONTAINING AQUEOUS, SOLVENT-FREE DISPERSIONS OF CATIONIC POLYMERS AND METHOD OF PREPARING SIZED PAPER BY USING THESE AGENTS

[75] Inventors: Kurt Dahmen, Mönchengladbach; Richard Mertens, Krefeld; Thomas Müller, Düsseldorf; Johann Schulte, Surwold, all of Germany

[73] Assignee: Stockhausen GmbH & Co. KG, Krefeld, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/793,332

[22] PCT Filed: Aug. 16, 1995

[86] PCT No.: PCT/EP95/03232

§ 371 Date: Feb. 25, 1997

§ 102(e) Date: Feb. 25, 1997

[87] PCT Pub. No.: WO96/06119

PCT Pub. Date: Feb. 29, 1996

[30] Foreign Application Priority Data

Aug. 25, 1994 [DE] Germany ..... 44 30 069

[51] Int. Cl.[6] ..... D21H 17/07

[52] U.S. Cl. ..... 162/168.2; 162/166; 162/168.3; 162/167; 106/243; 106/287.25

[58] Field of Search ..... 162/168.2, 168.3, 162/168.1, 158, 167, 166; 106/287.25, 243

[56] References Cited

U.S. PATENT DOCUMENTS

| | | | |
|---|---|---|---|
| 4,091,165 | 5/1978 | Hayama . | |
| 4,919,757 | 4/1990 | Ohmae et al. . | |
| 4,997,895 | 3/1991 | Ohmae et al. . | |
| 5,079,303 | 1/1992 | Ikeda et al. | 525/328.4 |
| 5,498,648 | 3/1996 | De Clercq et al. | 524/47 |
| 5,672,392 | 9/1997 | De Clercq et al. | 427/391 |

FOREIGN PATENT DOCUMENTS

| | | |
|---|---|---|
| 0 033 064 | 1/1981 | European Pat. Off. . |
| 91202006 | 9/1987 | European Pat. Off. . |
| 0 464 957 | 1/1992 | European Pat. Off. . |
| 3103917 | 2/1981 | Germany . |
| 3737615 | 11/1987 | Germany . |
| 3742330 | 12/1987 | Germany . |
| 3826825 | 8/1988 | Germany . |
| 887900 | 1/1962 | United Kingdom . |

OTHER PUBLICATIONS

Database WPI Week 1361, Feb. 10, 1989, Derwent Publications Ltd., London, GB; AN 3409, 'Cationic Oligomer', & JP, A, 63 251 409 (Nippon Shokubai K.K.Co. Ltd.) Oct. 18, 1988, Abstract.

Masatoshi Yoshida, "Cationic Oligomer", Abstract vol. 13, No. 61 (C–567) Feb. 10, 1989.

*Primary Examiner*—Peter Chin
*Assistant Examiner*—Steven Leavitt
*Attorney, Agent, or Firm*—Oblon, Spivak, McClelland, Maier & Neustadt, P.C.

[57] ABSTRACT

The present invention relates to agents for the pulp and/or surface sizing of paper, which comprise aqueous, solventless dispersions of cationic polymers, and to a process for sizing paper by using said agent. The sizing agents according to the present invention which can be used both in pulp and surface sizing obtain as active substance copolymers of a) 30–70 mole-% of a monomer I with b) 70–30 mole-% of a monomer II, and optionally c) 0–20 mole-% of $C_8$–$C_{30}$ monoolefins, and d) 0–10 mole-% of further monomers copolymerizable with a), b), and optionally c), the sum of monomers a), b), c), and d) amounting to 100 mole-%.

11 Claims, No Drawings

PAPER-SIZING AGENTS CONTAINING AQUEOUS, SOLVENT-FREE DISPERSIONS OF CATIONIC POLYMERS AND METHOD OF PREPARING SIZED PAPER BY USING THESE AGENTS

BACKGROUND OF THE INVENTION

1. Field of the Invention

The present invention relates to agents for the pulp and/or surface sizing of paper, which comprise aqueous, solventless dispersions of cationic polymers. The present invention further relates to a process for sizing paper by using said agents.

2. Discussion of the Background

In the production of ink resistant and printing papers the papers are sized at the surface or in the pulp; this is to decrease the wettability of cellulose and the absorption of water or aqueous liquids through the capillary system of the sheet, and to improve the absorption of printing inks, the whiteness and opacity as well as the mechanical properties of the paper sheet. The known sizing process and the agents normally used are described in Ullmanns encyclopedia, volume 17 (1979), pages 585–587 and 599.

It is also known to use cationic polymers in the sizing process, they stand out for a high substantivity towards cellulose fibers. Japanese Patent No. J 04 108 196 describes cationic sizing agents based on colophony and cationic polymers. Japanese Patent Nos. J 04 091 290, J 63 270 893, and J 59 159 198 describe sizing agents formed of dimeric alkylketenes and cationic polymers.

DE 37 37 615 C2 describes sizing agents representing resins modified with carboxylic acid, so-called fortified resins which are dispersed by portions of cationic copolymers. In this connection the cationic copolymers are obtained by polymerization in solution, and the production of the dispersed sizing agent from the anionically modified resins and the cationic copolymers is effected in a complicated method by removing the solvent from the copolymer by means of distillation, melting the modified resin, and dispersing in water, in some cases using surfactants. During application, the resin components not bound in the pulp load the process water and must be removed, if necessary by using additional auxiliaries.

DE 38 26 825 C2 describes cationic sizing agents that are formed from methyl (meth)acrylate, butyl (meth)acrylate, acrylic acid, and 10–30 percent by weight of portions of N,N-dimethylaminoethyl(meth)acrylate, and which comprise isopropanol or other organic solvents. The described sizing agents are unstable during storage and insufficiently active when applied.

EP 416 427 B1 describes sizing agents based on aqueous, cationic polymer dispersions whose polymer portion is formed of only 2–20%-wt. of a salt-forming, water-soluble monomer having groups of alkyl ammonium, alkyl sulfonium, or alkyl phosphonium, but which are always used with additional cationic polymers, such as retention agents and protective colloids (Poly-DADMAC). For this reason these polymers must nevertheless be used in larger amounts. Additionally, the described dispersions also comprise emulsifiers and, in particular, nonionic surfactants which—in addition to the water-soluble retention agents in the paper—may impair the sizing action and load the industrial process water.

SUMMARY OF THE INVENTION

Accordingly, it was the object of the present invention to improve the known cationic sizing agents by avoiding their disadvantages; in particular, to provide sizing agents that can be manufactured in a more economic and ecologically beneficial manner, which are stable in storage, can exclusively be used as sizing agents without employing additional components, and moreover have an improved action.

This object is achieved by using aqueous, solvent-free dispersions of cationic polymers as sizing agents, wherein the cationic polymers are obtained by radical polymerization in solution or dispersion, preferably in mass, of a) 30–70 mole-% of at least one monomer of the general formula

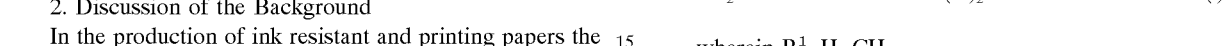

$$H_2C{=}CR^1{-}CO{-}X{-}R^2{-}N(R^3)_2 \quad (I)$$

wherein $R^1$=H, $CH_3$,
$R^2$=a $C_2$–$C_4$-alkylene group,
$R^3$=H, a $C_1$–$C_4$-alkyl group, and
X=O, NH with b) 70–30 mole-% of at least one monomer of the formula

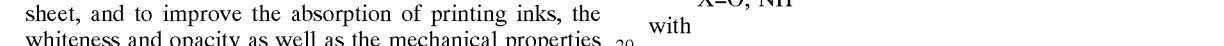

$$H_2C{=}CR^1{-}CO{-}X{-}R^4 \quad (II)$$

wherein $R^1$ and X have the meaning stated for compound I and $R^4$=a $C_8$–$C_{30}$-alkyl group, and optionally c) 0–20 mole-% of at least one $C_8$–$C_{30}$-monoolefin, and d) 0–10 mole-% of at least one further monomer copolymerizable with a), b) and optionally c), subsequent neutralization and optional quaternization of the copolymers, and dispersion in water or aqueous liquids, wherein the sum of monomers a), b), c), and d) amounts to 100 mole-%.

DETAILED DESCRIPTION OF THE PREFERRED EMBODIMENTS

The monomers of group a) include acrylic and/or methacrylic derivatives with an amine function. On the one hand, they are necessary for fixation to the cellulose fiber, and, on the other hand, their partially or completely neutralized form provides the dispersibility of the polymer in water. Suitable monomers include N,N-dimethylaminoethyl(meth)acrylate, N,N-dimethylaminopropyl(meth)acrylate, N,N-dimethylaminoethyl(meth)acrylamide, and N,N-dimethylaminopropyl(meth)acrylamide. N,N-dimethylaminoethylacrylate and N,N-dimethylaminopropylacrylamide are preferably used.

The monomers of group a) are present in the copolymer in an amount of 30–70 mole percent. If one remains under these limits, instable dispersions are generally obtained, whereas a portion of more than 70 mole-% considerably deteriorates the sizing effect. It is preferred that a portion amounting to 40–60 mole-% of said monomers in the copolymer be used.

The monomers of group b) are hydrophobic esters or amides of acrylic and/or methacrylic acid. They mainly provide the sizing effect. Suitable monomers are, for example, 2-ethylhexyl (meth)acrylate, n-octyl (meth) acrylate, isononyl (meth)acrylate, decyl (meth)acrylate, lauryl (meth)acrylate, isotridecyl (meth)acrylate, myristyl (meth)acrylate, stearyl (meth)acrylate, $C_{18-22}$-(meth) acrylate, 2-ethylhexyl (meth)acrylamide, n-octyl (meth) acrylamide, isononyl (meth)acrylamide, decyl (meth) acrylamide, lauryl (meth)acrylamide, isotridecyl (meth) acrylamide, myristyl (meth)acrylamide, stearyl (meth)

acrylamide, $C_{18-22}$-(meth)acrylamide. The monomers are produced in known manner from the hydrophobic alcohols or amines and the (meth)acrylic acid or reactive derivatives thereof. Many of these monomers are commercially available. Stearyl methacrylate is preferably used from this group.

Part of the monomers of group b) can be replaced by long-chain monoolefins. Suitable examples for this purpose include, for example, 1-octene, 1-decene, 1-dodecene, 1-tetradecene, 1-hexadecene, 1-octadecene, 1-eicosene, and $C_{20-24}$ or $C_{30+}$-alpha-olefin fractions. These monomers are also commercially available. They may be used in relation to the monomer group b) in an amount of 0.001 to 1:1. 1-octadecene and $C_{20-24}$-alpha-olefin mixtures are preferably used.

Optionally, up to 10 mole-% of additional alpha,beta-unsaturated monomers which are copolymerizable with the monomers of groups a), b), and optionally c) may be present in the polymerization recipe in order to achieve special properties. The condition for their use is the fact that they can be processed into a homogeneous mixture with the above-mentioned monomers, optionally at a higher temperature. Suitable examples include, e.g., styrenes, vinyl ester, vinyl ether, (meth)acrylic acid and/or (meth)acrylamide.

The sizing agents preferably used according to the present invention comprise copolymers which are manufactured under rejection of organic solvents by means of mass polymerization in a manner known per se.

The polymerization is carried out at temperatures of 20 to 200° C., preferably 60 to 160° C. It is initiated thermally, photochemically, or redox-catalytically, preferably with the aid of peroxo and/or azo compounds. Owing to the mainly hydrophobic nature of the monomers, oil-soluble initiators are preferred, e.g., 2,2'-azobis(isobutyronitrile) (AIBN), 2,2'-azobis(2-methylbutyronitrile), 4,4'-azo(4-cyanopentanoic acid), 2,2'-azobis(2,4-dimethylvaleronitrile), di-tert-butyl peroxide, dibenzoyl peroxide, or tert-butylperoxy-2-ethyl hexanoate.

The number average of the copolymers' molar mass amounts to 1,000 to 100,000 g/mole. The molar mass is preferably controlled by using known regulators, such as mercaptoethanol or dodecyl mercaptan.

In additionally preferred embodiments, a part or the total amount of the monomers is prepared, the initiator—either completely or in partial amounts—added to the polymerization mixture at a suitable temperature, and the further reaction carried out under adiabatic conditions, with the resulting heat of polymerization heating the reaction batch.

After polymerization, the copolymer is immediately neutralized with dilute acid and emulsified in water. In this connection, the amount of acid is chosen such that a pH of 8 to 3 adjusts in the final product. Both inorganic acids, such as hydrochloric acid or sulfuric acid, and organic acids, in particular carboxylic acids, such as formic acid or acetic acid, are suitable for neutralization purposes.

After neutralization or emulsification, initiators may be added once more to reduce the residual monomer content, if necessary. To this end both oil-soluble and water-soluble initiator systems are suitable.

According to another preferred embodiment, copolymers are used the amino groups of which are partially or completely reacted with a suitable quaternizing agent. Examples of suitable quaternizing agents include methyl chloride, benzyl chloride, dimethyl sulfate and/or epichlorohydrin. The amount of quaternizing agent is chosen such that the degree of quaternization adjusts to 1–100 mole-%, preferably 5 to 50 mole-%.

The solids content of the polymer dispersions to be used according to the present invention amounts to 10–60%-wt., preferably 20–50%-wt., and most preferably 30–40%-wt.

Most surprisingly, the copolymer dispersions to be used according to the present invention—despite the fact that they are produced without any additional auxiliary agents—stand out for a good dispersion stability; for this reason there is no separation or coagulation of polymer even after several weeks of storage at 50° C. In addition, and this cannot be expected per se, they stand out for a good sizing action, making them suitable for the water-repellent sizing of papers, in particular of writing and printing papers. In this connection, they may be used both in pulp sizing and as surface sizing agents.

The present invention further relates to a process for sizing paper by using the agents according to the present invention, that is both for pulp and surface sizing.

In pulp sizing, the polymer dispersions are added to the high-density or low-density pulp at 0.1–3.0% of active substance (relative to abs. dry pulp), whereas in surface sizing, 0.1–5.0 g of active substance per $m^2$ is applied to the paper after the drying part. In most cases, immediate sizing can be achieved with the polymer dispersions, that means the desired water repellency of the paper is achieved immediately after the production process. The disadvantageous process of aging freshly sized papers, which is frequently necessary when currently used sizing agents are employed in order to obtain hydrophobic effects and the resulting paper properties, can therefore be omitted to a great extent.

In addition, the amount of cationic polymer dispersions used can excellently adjust a graded sizing degree of the papers, which is reproducible both in the acid and the neutral or alkaline paper manufacture. Most advantageously, there is no need to use additional auxiliary agents for the sizing.

The present invention will be illustrated in the following Examples.

General Specification for Preparation A:

The monomers and optional regulators are placed in a reactor equipped with mechanical stirrer, reflux condenser, and internal thermometer and purged with nitrogen gas for 30 minutes. Then heating to the intended starting temperature is effected. Subsequently, the initiator is added. The starting polymerization causes a temperature elevation. After exceeding the temperature maximum, stirring at the intended polymerization temperature is continued for three hours. Subsequently, dilute acid is added for neutralization, and stirring at 60–90° C. continued for another 30 minutes, if necessary, after renewed initiator addition. Cooling to 30–40° C. is effected under stirring, and the product is filled.

General Specification for Preparation B:

The solvent and optional regulators are placed in the same reactor as in formula A and gassed with nitrogen. Afterwards heating to the intended polymerization temperature is effected; the monomers and the initiator (optionally diluted with additional solvent) are fed simultaneously through different inlets over the intended reaction time. After termination of the feeding, the reaction is allowed to continue for 2 hours. Subsequently, the polymer is neutralized with dilute acid as is formula A and emulsified. The solvent is largely removed from the emulsion by distillation.

Manufacture of the Copolymers:

The copolymer dispersions manufactured according to the abovementioned instructions are listed in the following Examples. The given numerical data represent parts by weight. The abbreviations used have the following meaning:

| | |
|---|---|
| ACP | 4,4'-azo(4-cyanopentanoic acid) |
| AIBN | 2,2'-azobis(isobutyronitrile) |
| DIMAPA | N,N-dimethylaminopropylacrylamide |
| DM | dodecyl mercaptan |
| DMAEA | N,N-dimethylaminoethylacrylate |
| DMS | dimethyl sulfate |
| ECH | epichlorohydrin |
| EHMA | ethylhexyl methacrylate |
| HAc | acetic acid |
| ME | mercaptoethanol |
| StMA | stearyl methacrylate |
| dry subst. | dry substance |

The storage stability was rated at room temperature and at 50° C. A dispersion which does not separate during at least 7 days of storage at 50° C. and during 1 month of storage at room temperature is considered to be stable. The viscosities were each measured at room temperature using a Brookfield rotary viscometer.

| | |
|---|---|
| Copolymer A: | method A, 60 DIMAPA, 100 StMA, 1.5 ME, $T_{start}$ 80° C., 1.0 AIBN, 1.5 h at 90–150° C., 38.0 HCl (37%), 410 $H_2O$ demin., bright, stable emulsion, dry subst. 30%, 460 mPas, pH (10% in $H_2O$) 2.9 |
| Copolymer B: | method A, 60 DIMAPA, 100 StMA, 7.5 ME, $T_{start}$ 80° C., 5.0 ACP, 1.5 h at 90–120° C., 35.7 HCl (37%), 127 $H_2O$ demin., bright, stable emulsion, dry subst. 50%, 900 mPas, pH (10% in $H_2O$) 3.8 |
| Copolymer C: | method A, 50 DIMAPA, 100 StMA, 1.5 ME, $T_{start}$ 80° C., 1.0 AIBN, 1.5 h at 90–150° C., 31.5 HCl (37%), 265 $H_2O$ demin., subsequent initiation using 1.0 $H_2O_2$ (30%) and 0.1 ME bright, stable emulsion, dry subst. 35%, 34,000 mPas, pH (10% in $H_2O$) 3.2 |
| Copolymer D: | method A, 50 DIMAPA, 110 StMA, 1.5 ME, $T_{start}$ 80° C., 1.0 AIBN, 90 min. at 90–150° C., 31.5 HCl (37%), 400 $H_2O$ demin., subsequent initiation using 0.2 ABAH in 5 $H_2O$ demin. bright, stable emulsion, dry subst. 30%, 740 mPas, pH (10% in $H_2O$) 3.1 |
| Copolymer E: | method A, 50 DIMAPA, 110 StMA, 1.5 ME, $T_{start}$ 80° C., 1.0 AIBN, 2 h at 90–140° C., 31.5 HCl (37%), 400 $H_2O$ demin., bright, stable emulsion, dry subst. 30%, 1680 mPas, pH (10% in $H_2O$) 3.1 |
| Copolymer F: | method A, 50 DIMAPA, 100 StMA, 1.5 ME, $T_{start}$ 80° C., 1.0 AIBN, 1.5 h at 90–150° C., 18.8 HAc, 500 $H_2O$ demin., aftertreatment with 14.8 ECH, 5 h 30° C bright, stable emulsion, dry subst. 26%, 150 mPas, pH (10% in $H_2O$) 5.7 |
| Copolymer G: | like Copolymer F, however, aftertreatment with 1.48 ECH, 5 h 80° C., bright, stable emulsion, dry subst. 26%, 280 mPas, pH (10% in $H_2O$) 5.2 |
| Copolymer H: | like Copolymer F, however, aftertreatment with 20.2 DMS, 5 h 80° C., bright, stable emulsion, dry subst. 26%, 120 mPas, pH (10% in $H_2O$) 4.4 |
| Copolymer I: | method B, 100 isopropanol, 1.5 ME, 50 DIMAPA, 100 StMA, 2.0 ACP in 20 isopropanol, addition for 1 h at 75–80° C., 5 h 90° C., 30.0 HCl (37%), 250 $H_2O$ demin. 1 h at 80° C., subsequent removal of isopropanol by distillation bright, stable emulsion, dry subst. 35%, 250 mPas, pH (10% in $H_2O$) 4.3 |
| Copolymer J: | method A, 50 DIMAPA, 95 StMA, 5 EHMA, 1.5 ME, $T_{start}$ 80° C., 1.0 AIBN, 1.5 h 80–155° C., 31.5 HCl (37%), 265 $H_2O$ demin., subsequent initiation using 0.2 ABAH in 5 $H_2O$ demin., 1 h 90° C. bright, stable emulsion, dry subst. 35%, 750 mPas, pH (10% in $H_2O$) 5.9 |
| Copolymer K: | method A, 72 DMAEA, 165 StMA, 1.5 ME, 1.0 AIBN, 1.5 h 80–135° C., 49.2 HCl (37%), 1030 $H_2O$ demin., subsequent initiation using 0.2 ABAH in 5 $H_2O$ demin., 1 h 90° C. bright, stable emulsion, dry subst. 20%, 480 mPas, pH (10% in $H_2O$) 3.0 |
| Comparative product: | according to Example 4 of DE 38 26 825 C2 white emulsion, forms layers after 3 days at room temperature dry subst. 16%, 30 mPas, pH (10% in $H_2O$) 3.2 |

To examine the sizing action of the polymer dispersions, sheets of paper having a basis weight of about 100 g/m$^2$ were manufactured in a "Rapid-Köthen"-sheet former. A ground fiber cellulose (birch-sulfate) or a waste paper (newsprint paper), or a wood pulp were used as raw materials.

The sizing agent to be examined was added to the pulp/water-mixture and mixed for 15 seconds. Then the sheet was formed in the sheet former and dried in the vacuum drier of the Rapid-Köthen-device at 92° C. for 10 minutes.

The sizing values, measured according to DIN 53132 "Water absorption according to Cobb", were determined immediately after production, after an additional drying at 110° C. for 10 minutes, and after 24 h. The results are listed in the following Tables.

TABLE 1

| | | | | Cobb-value (g/m$^2$) | | |
|---|---|---|---|---|---|---|
| Example | Co-polymer | Amount[1)] in % | Paper pulp | after manu-facture | after add. drying | after 24 h |
| 1 | A | 2.0 | cellulose | 36 | 31 | 26 |
| 2 | B | 2.0 | cellulose | 88 | 28 | 18 |
| 3 | C | 2.0 | cellulose | 28 | 21 | 20 |
| 4 | D | 2.0 | cellulose | 53 | 30 | 28 |
| 5 | E | 2.0 | cellulose | 68 | 25 | 19 |
| 6 | H | 2.0 | cellulose | 28 | 25 | 23 |
| 7 | I | 2.0 | cellulose | n.b. | 61 | 36 |
| 8 | J | 2.0 | cellulose | 86 | 21 | 19 |
| 9 | K | 2.0 | cellulose | n.d. | 58 | 34 |
| Comp. Exam. 1 | Comp. Prod. | 2.0 | cellulose | 155 | 54 | 51 |

[1)]% dry subst. polymer, relative to abs. dry paper pulp

Table 1 shows that the copolymers to be used according to the preset invention provide a very good immediate sizing. The Comparative Example does not show an immediate sizing and results in considerably inferior values even after 24 h, as compared to the Examples according to the present invention.

TABLE 2

| | | | | Cobb-value (g/m$^2$) | | |
|---|---|---|---|---|---|---|
| | Co-polymer | Amount[1)] in % | Paper pulp | after manu-facture | after add. drying | after 24 h |
| 10 | B | 0.50 | cellulose | — | 211 | 49 |
| | | 1.00 | cellulose | 175 | 34 | 18 |

TABLE 2-continued

| | Co-polymer | Amount[1)] in % | Paper pulp | Cobb-value ($g/m^2$) after manu-facture | after add. drying | after 24 h |
|---|---|---|---|---|---|---|
| 11 | C | 0.50 | cellulose | — | 126 | 40 |
| | | 1.00 | cellulose | 114 | 38 | 22 |
| 12 | F | 0.25 | cellulose | — | 110 | 101 |
| | | 0.50 | cellulose | 91 | 19 | 19 |
| 13 | G | 0.50 | cellulose | n.d. | 50 | 43 |
| | | 1.00 | cellulose | 58 | 24 | 22 |
| 14 | H | 1.00 | cellulose | 66 | 38 | 33 |
| Comp. | Comp. | 0.50 | cellulose | — | 169 | 112 |
| Exam.2 | Prod. | 1.00 | cellulose | 157 | 75 | 65 |

[1)]% dry subst. polymer, relative to abs. dry paper pulp

Table 2 illustrates that when the copolymers are used according to the present invention an advantage over known solvents can be observed even at low concentrations.

TABLE 3

| Example | Copoly-mer | Amount in % | Paper pulp | Cobb-value ($g/m^2$) after manu-facture | after add. drying | after 24 h |
|---|---|---|---|---|---|---|
| 15 | F | 0.5 | wood pulp | — | 109 | 88 |
| | | 1.0 | wood pulp | 186 | 37 | 24 |
| | | 2.0 | wood pulp | 33 | 26 | 17 |
| 16 | G | 1.0 | wood pulp | n.d. | 69 | 61 |
| | | 2.0 | wood pulp | 48 | 39 | 31 |
| 17 | H | 1.0 | wood pulp | — | — | 62 |
| | | 2.0 | wood pulp | — | 44 | 31 |

TABLE 4

| Ex-ample | Copoly-mer | A-mount[1)] in % | Paper pulp | Cobb-value ($g/m^2$) after manu-facture | after add. drying | after 24 h |
|---|---|---|---|---|---|---|
| 18 | B | 2.0 | waste paper | — | 171 | 81 |
| 19 | D | 2.0 | waste paper | — | 172 | 95 |
| 20 | F | 0.5 | waste paper | — | 142 | 141 |
| | | 1.0 | waste paper | — | 54 | 38 |
| | | 2.0 | waste paper | 89 | 23 | 18 |
| 21 | G | 2.0 | waste paper | 112 | 48 | 42 |
| Comp. | Comp. | 1.0 | waste paper | — | 166 | 157 |
| Exam. 3 | Prod. | 2.0 | waste paper | — | 116 | 109 |

[1)]% dry subst. polymer, relative to abs. dry paper pulp

The results shown in Table 4 demonstrate that according to the present invention, as compared to the Comparative Product, a considerably improved immediate sizing—which is further improved after 24 h of storage—is achieved even in case of waste paper which can only hardly be rendered hydrophobic.

We claim:

1. Paper sizing agents comprising cationic, aqueous, solvent-free dispersions of cationic polymers, characterized by a content of cationic polymers which are obtained by radical polymerization in solution or dispersion or in bulk of a) 30–70 mole-% of at least one monomer of the general formula $$H_2C{=}CR^1{-}CO{-}X{-}R^2{-}N(R^3)_2 \quad (I)$$

wherein $R^1$=H, $CH_3$,
$R^2$=a $C_2$–$C_4$-alkylene group,
$R^3$=H, a $C_1$–$C_4$-alkyl group, and
X=O, NH with b) 70–30 mole-% of at least one monomer of the formula $$H_2C{=}CR^1{-}CO{-}X{-}R^4 \quad (II)$$

wherein $R^1$ and X have the meaning stated for compound (I) and $R^4$=a $C_8$–$C_{30}$-alkyl group, and c) 0–20 mole-% of at least one $C_8$–$C_{30}$-monoolefin, and d) 0–10 mole-% of at least one further monomer copolymerizable with a), b) and c), subsequent neutralization and optional quaternization of the copolymers, and dispersion in water or aqueous liquids, wherein the sum of monomers a), b), c), and d) amounts to 100 mole-%.

2. The paper sizing agents according to claim 1 characterized in that the aqueous copolymer dispersions comprise as monomers of group a) N,N-dimethylaminopropyl(meth) acrylamide and/or N,N-dimethylaminoethyl(meth)acrylate, and as monomer of group b) stearyl (meth)acrylate.

3. The paper sizing agents according to claim 1 characterized by a content of a copolymer which, after polymerization, is neutralized with inorganic and/or organic acids, and emulsified with water, the pH-value in the end product being in the range of 3.0–8.0, and the amino groups of the monomers of group a) optionally being reacted with a quaternizing agent in the molar ratio of amino groups to quaternizing agents of 100:1 to 1:1.

4. The paper sizing agents according to claim 1 characterized by a content of a copolymer quaternized with epichlorohydrin in the molar ratio of amino groups to epichlorohydrin of 50:1 to 1:1.

5. The paper sizing agents according to claim 1 characterized by a solids content of 10–60%-wt. of polymer.

6. The paper sizing agents according to claim 5 characterized by a solids content of 20–50%-wt of polymer.

7. The paper sizing agents according to claim 6 characterized by a solids content of 30–40%-wt of polymer.

8. A process for the production of paper sized in the pulp by using a cationic copolymer dispersion, characterized in that an aqueous copolymer dispersion as defined in claim 1 is used as pulp sizing agent, which is mixed to the high-density or low-density pulp in an amount of 0.1% to 3.0% of copolymer, relative to abs. dry pulp, under intense stirring, and that the sized paper is isolated and dried.

9. A process for the production of paper sized at the surface by using a cationic copolymer dispersion, characterized in that an aqueous copolymer dispersion according to claim 1 is used as surface sizing agent, with 0.1–5.0 g of copolymer per $m^2$ of paper being applied after the drying section.

10. The paper sizing agents according to claim 2, characterized in that the aqueous copolymer dispersions comprise as monomers of group a) N,N-dimethylaminopropylacrylamide and/or N,N-dimethylaminoethylacrylate.

11. The paper sizing agents according to claim 3, wherein said inorganic and/or organic acids are carboxylic acids.

* * * * *